US008261440B2

(12) United States Patent
Furuya et al.

(10) Patent No.: US 8,261,440 B2
(45) Date of Patent: Sep. 11, 2012

(54) METHOD FOR INSERTING A TERMINAL OF AN ELECTRICAL WIRE

(75) Inventors: Hiroshi Furuya, Shizuoka (JP); Kazuhiko Sugimura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 424 days.

(21) Appl. No.: 12/073,839

(22) Filed: Mar. 11, 2008

(65) Prior Publication Data

US 2008/0276457 A1 Nov. 13, 2008

(30) Foreign Application Priority Data

May 11, 2007 (JP) ..... 2007-127089

(51) Int. Cl.
*H01R 43/00* (2006.01)

(52) U.S. Cl. ..... 29/857; 29/837; 29/854; 29/862; 29/863; 29/874

(58) Field of Classification Search ..... 29/857, 29/876, 748, 837.854, 862, 863, 874, 747, 29/33 M; 439/246, 401, 407, 733, 596, 595, 439/603; 324/538
See application file for complete search history.

(56) References Cited

U.S. PATENT DOCUMENTS 5,127,159 A * 7/1992 Kudo et al. ..... 29/863
5,169,329 A * 12/1992 Taguchi ..... 439/188
5,232,380 A * 8/1993 Inoue et al. ..... 439/607.5
5,477,606 A * 12/1995 Igura ..... 29/721
5,607,327 A * 3/1997 Tsuji et al. ..... 439/752
5,659,949 A * 8/1997 Ohba et al. ..... 29/753
5,701,079 A * 12/1997 Yagi et al. ..... 324/538
5,996,223 A * 12/1999 Ogawa et al. ..... 29/861
6,000,972 A * 12/1999 Abe ..... 439/733.1
6,338,638 B2 * 1/2002 Kodama ..... 439/246
6,699,079 B2 * 3/2004 Machida et al. ..... 439/752

FOREIGN PATENT DOCUMENTS

JP 09-167671 A 6/1997
JP 2006-092841 4/2006

OTHER PUBLICATIONS

Office Action for Japanese Patent Application No. 2007-127089 issued Nov. 22, 2011.

* cited by examiner

*Primary Examiner* — Derris Banks
*Assistant Examiner* — Tai Nguyen
(74) *Attorney, Agent, or Firm* — Edwards Wildman Palmer LLP

(57) ABSTRACT

A terminal insertion apparatus having a connector housing holding unit, a terminal insertion unit, and a control unit. The connector housing holding unit holds a connector housing movably in horizontal and vertical directions. The terminal insertion unit inserts a terminal attached to an electric wire into a terminal accommodating chamber of the connector housing. After the terminal insertion unit has inserted an end of the terminal into the terminal accommodating chamber, the control unit controls a movable supporting unit of the connector housing holding unit so as to move a holding jig by amounts of movement in horizontal and vertical directions so that the terminal is not caught on an inner surface of the terminal accommodating chamber, and then the terminal is completely inserted in the terminal accommodating chamber.

4 Claims, 14 Drawing Sheets

| TERMINAL ACCOMMODATING CHAMBER No. | HORIZONTAL AMOUNT OF MOVEMENT | VERTICAL AMOUNT OF MOVEMENT |
|---|---|---|
| ① | 1A mm | 1B mm |
| ② | 2A mm | 2B mm |
| ③ | 3A mm | 3B mm |
| ④ | 4A mm | 4B mm |
| ⑤ | 5A mm | 5B mm |
| ⑥ | 6A mm | 6B mm |
| ⑦ | 7A mm | 7B mm |
| ⑧ | 8A mm | 8B mm |
| ⑨ | 9A mm | 9B mm |
| ⑩ | 10A mm | 10B mm |

METHOD FOR INSERTING A TERMINAL OF AN ELECTRICAL WIRE

CROSS REFERENCE TO RELATED APPLICATION

The priority application Japan Patent Application No. 2007-127089 upon which this patent application is based is hereby incorporated by reference.

BACKGROUND OF THE INVENTION

1. Field of the Invention

The present invention relates to a method and an apparatus for inserting a terminal of an electric wire, into a terminal accommodating chamber of a connector housing.

2. Description of the Related Art

In manufacturing of a wiring harness for an automobile or any other movable bodies, various terminal insertion methods and devices have been conventionally used to insert a terminal 103 attached to an end of an electric wire 102 into a terminal accommodating chamber 101 of a connector housing 100 (see FIG. 16 and, for example, Japanese Patent Application Laid-Open Publication No. 2006-92841).

A basic configuration and operation of the conventional apparatus designed to implement the conventional terminal insertion method can be roughly sketched as follows. The conventional terminal insertion apparatus includes a body, a holding jig configured to hold the connector housing, a wire clamping bar configured to hold the electric wire, and an insertion head configured to insert the terminal into the terminal accommodating chamber. The body of the apparatus is installed for example on a floor of a factory. The holding jig, which is mounted on the body of the apparatus, is configured to hold the connector housing 100. The wire clamping bar holds the electric wire 102 to which the terminal 103 is attached. The insertion head takes the electric wire 102 off the wire clamping bar, and inserts the terminal 103 into the terminal accommodating chamber 101 of the connector housing 100.

The terminal insertion apparatus and the terminal insertion method as described above, however, have a problem: When inserting the terminal 103 into the terminal accommodating chamber 101, the insertion head moves the terminal 103 lengthwise of the terminal accommodating chamber 101. This operation may cause the terminal 103 to get caught on a protrusion 101*a* on an inner surface of the terminal accommodating chamber 101 of the connector housing 100 with a particular part number (see FIG. 17). When the terminal 103 is caught on the inner surface of the terminal accommodating chamber 101, the conventional insertion head obstinately attempts to insert the terminal 103 further into the terminal accommodating chamber 101 toward a far end of the terminal accommodating chamber 101. This behavior of the insertion head causes the terminal 103 to become slanted, making it difficult or even impossible to insert the terminal 103 into the terminal accommodating chamber 101 fully and completely (see FIG. 18). The worst case scenario is buckling and bending of the electric wire caused by the insertion head attempting to insert the terminal 103 that has been caught by the protrusion 101 a forcibly into the terminal accommodating chamber 101. Unfortunately, such a bent or deformed electric wire is defective.

SUMMARY OF THE INVENTION

In view of the foregoing background, an object of the present invention is to provide a method and an apparatus for inserting a terminal into a terminal accommodating chamber that are capable of preventing the terminal from being caught on an inner surface of the terminal accommodating chamber and inserting the terminal into the terminal accommodating chamber securely and completely.

In order to attain the above objective, the present invention provides the method for inserting the terminal into the terminal accommodating chamber of the connector housing, by movably holding the connector housing, holding the terminal and the electric wire, inserting an end of the terminal into the terminal accommodating chamber, moving the connector housing by an amount of movement prescribed such that the terminal is not caught on the inner surface of the terminal accommodating chamber, and inserting the terminal completely into the terminal accommodating chamber.

The above terminal insertion method allows accurate positioning of the connector housing relative to the terminals to be inserted and ensures that the terminal is not caught on the inner surface of the terminal accommodating chamber, thereby preventing buckling and bending of the electric wire, and achieves more reliable and complete insertion of the terminal into the terminal accommodating chamber.

The present invention also provides an apparatus for inserting the terminal of the electric wire into the terminal accommodating chamber of the connector housing. The terminal insertion apparatus of the present invention includes: a connector housing holding unit that holds the connector housing; a movable supporting unit by which the connector housing holding unit is movably supported; a terminal insertion unit that holds the terminal and the electric wire and inserts the terminal into the terminal accommodating chamber; and a control unit which stores information on the amount of movement, i.e., a degree of adjustment by which the movable supporting unit moves the connector housing holding unit after the terminal insertion unit has inserted the end of the terminal into the terminal accommodating chamber. When the terminal insertion unit has inserted the end of the terminal into the terminal accommodating chamber, the movable supporting unit controlled by the control unit moves the connector housing holding unit based on the information that is stored, and then the terminal is fully inserted into the terminal accommodating chamber.

With the configuration described above, the control unit of the terminal insertion apparatus of the present invention controls the terminal insertion apparatus 1 so as to move the connector housing after insertion of the end of the terminal into the terminal accommodating chamber, the positioning of the connector housing relative to the terminal to be inserted is adjusted so that the terminal is not caught on the inner surface of the terminal accommodating chamber, thus allowing the terminal to be securely inserted into the terminal accommodating chamber.

Preferably, the control unit of the terminal insertion apparatus of the present invention stores the amounts of movement in insertion of the terminals into each of the terminal accommodating chambers on a per-part-number basis for each connector housing, and the movable supporting unit controlled by the control unit moves the connector housing holding unit by the stored amount of movement.

With the configuration described above, the control unit of the terminal insertion apparatus stores information on the amount of movement for accurate positioning of the terminal accommodating chambers relative to the terminals to be inserted based upon the part numbers of the connector housings, and moves the connector housing by the above amount of movement. This allows the terminal to be securely and completely inserted into the terminal accommodating chamber with accuracy on the per-part-number-basis for the various connector housings.

Preferably, the terminal insertion apparatus of this invention includes an input device used to enter information indicative of a part number of the connector housing held by the connector housing holding unit into the control unit, and, after the terminal insertion unit has inserted the end of the terminal into the terminal accommodating chamber, the control unit controls the movable supporting unit so as to move the connector housing holding unit by the amount of movement for the connector housing having the part number that has been entered by the input device.

With the configuration described above, since the terminal insertion apparatus of the present invention includes the input device provided so as to enter the part number of the connector housing into the control unit, the positioning of the terminal relative to the terminal accommodating chamber of the connector housing can be precisely made so that the terminal is not caught by the inner surface of the terminal accommodating chamber, thereby achieving more reliable and complete insertion of the terminal into the terminal accommodating chamber.

BRIEF DESCRIPTION OF THE DRAWINGS

These and other objects, features, and advantages of the present invention will become more apparent upon reading of the following detailed description along with the accompanied drawings, in which.

DESCRIPTION OF THE PREFERRED EMBODIMENT

Figure 1:
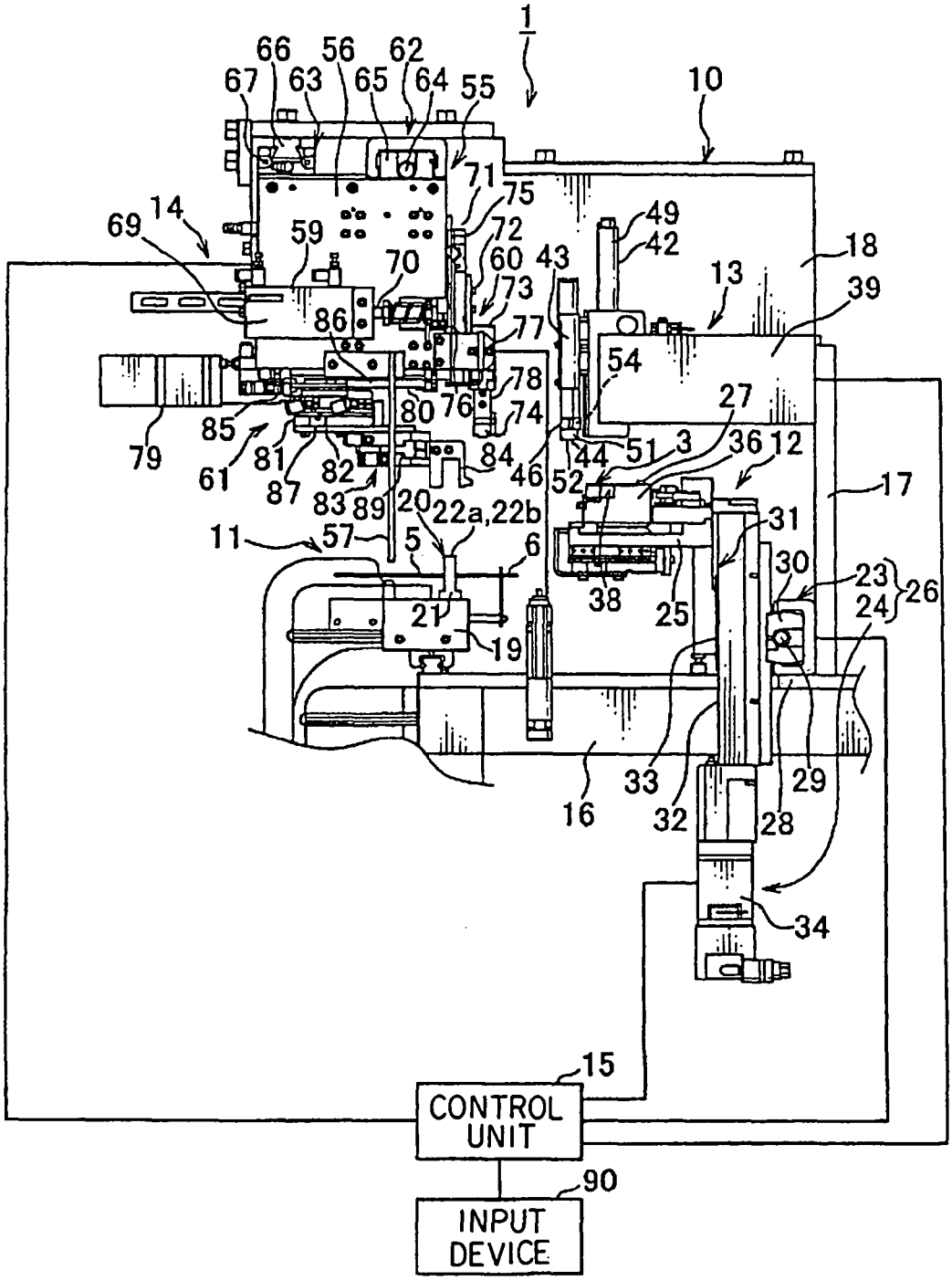
FIG. 1 is a side elevation of an overall configuration of a terminal insertion apparatus according to the first embodiment of the present invention.

The following describes a terminal insertion apparatus 1 configured to implement a method for inserting a terminal according to one embodiment of the present invention with reference to FIGS. 1 to 15. Referring to FIGS. 1 and 7, the terminal insertion apparatus 1 is designed to insert a terminal 6 of an electric wire 5 into a terminal accommodating chamber 4 of a connector housing 3 of a connector 2 (see also FIG. 7). More specifically, the terminal insertion apparatus 1 of FIG. 1 is the apparatus that inserts the terminal 6 into the terminal accommodating chamber 4 of the various connector housings 3 to which different part numbers are assigned.

The connector housing 3 is box-shaped and made of an electrically insulating synthetic resin. The connector housing 3 has a plurality of the terminal accommodating chambers 4 that are spaces linearly extending through the connector housing 3 for receiving therein the terminals 6 attached to the electric wires 5.

The terminal 6 is attached to an end of the electric wire 5. The electric wire 5 is a covered wire that includes a core wire and an electrically insulating coating. Note that the terminal 6 that appears in the embodiment is always attached to the electric wire 5. The terminal 6 is always attached to the end of the electric wire 5 and the electric wire 5 always has the terminal 6.

The connector 2 includes the connector housing 3, the electric wires 5, and the terminal 6 attached to the electric wires 5 and received in the terminal accommodating chamber 4 of the connector housing 3. The connector 2 is brought into engagement with a mating connector, serving as a constituent part of an automotive wiring harness. Also, either one of the terminal accommodating chamber 4 and the terminal 6 has a locking arm that retains the other one of them. It is by virtue of the locking arm that the connector housing 3 is securely locked with the terminal 6. Various protruding and/or recess portions along with the aforementioned locking arm are formed as required on an inner surface of the terminal accommodating chamber 4. A shape of the connector housing 3 and arrangement of the terminal accommodating chambers 4 vary depending upon the part number of the connector housing 3. Note that, all the connector housings 3 that appear in the embodiment have their individually assigned part numbers.

Referring to FIG. 1, the terminal insertion apparatus 1 has (a) an apparatus body 10, (b) an electric wire holding unit 11, (c) a connector housing holding unit 12, (d) a guiding unit 13, (e) a terminal insertion unit 14, and (f) a control unit 15. These components of the terminal insertion apparatus 1 is described below in order of mention above.

The apparatus body 10 is installed for example on a floor of a factory. The apparatus body 10 has a table 16 whose upper surface is flat and level in a horizontal direction, an upstanding pillar 17, and an upstanding plate 18. The upstanding pillar 17 and the upstanding plate 18 are secured to each other, standing upright upon the upper surface of the table 16.

Figure 3:
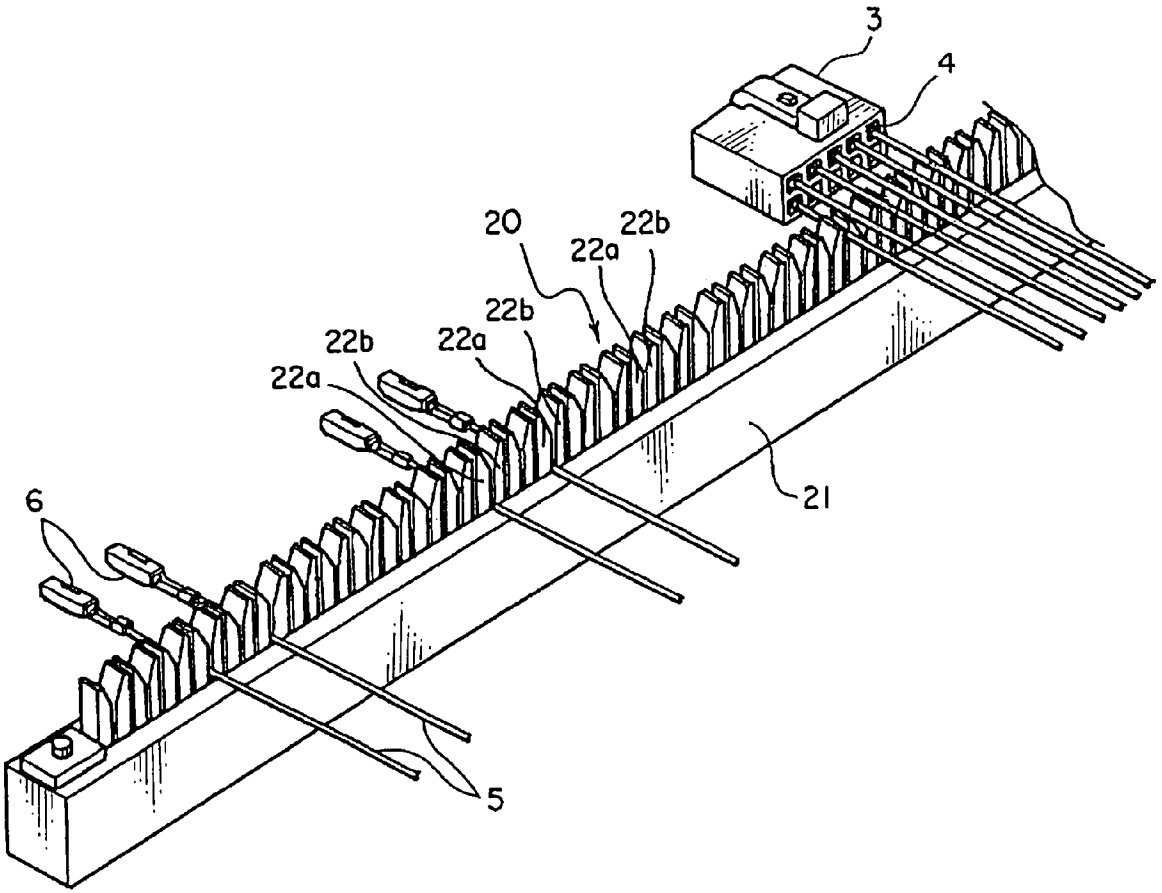
FIG. 3 is a perspective view of a wire clamping bar of the terminal insertion apparatus of FIG. 1.

The electric wire holding unit 11 includes a wire-holding-unit body 19 and a wire clamping bar 20 that is detachable from the wire-holding-unit body 19 (see also FIG. 3). The wire-holding-unit body 19 is disposed on the table 16 of the apparatus body 10. The wire-holding-unit body 19 is formed in a shape of a bar or a pillar, and is longitudinally parallel to the horizontal direction. It should be noted that the wire-holding-unit body 19 is longitudinally parallel to a direction from a distal side toward a proximal side or vice versa in FIG. 1.

Referring to FIG. 3, the wire clamping bar 20 includes a bar-shaped wire-clamping-bar body 21 and a plurality of a pair of sandwiching members 22*a* and 22*b* upstanding on the wire-clamping-bar body 21. The wire-clamping-bar body 21 is detachable from the wire-holding-unit body 19. The wire-clamping-bar body 21 is disposed on the wire-holding-unit body 19 in such a manner that the wire-clamping-bar body 21 is longitudinally parallel to the wire-holding-unit body 19.

The sandwiching members 22*a* and 22*b* are movably supported by the wire-clamping-bar body 21 in such a manner that the sandwiching members 22*a* and 22*b* can move close to and away from each other. The sandwiching members 22*a* and 22*b* are energized in a direction where the sandwiching members 22*a* and 22*b* come close to each other. The sandwiching members 22*a* and 22*b* get close to each other lengthwise of the wire-clamping-bar body 21. Also, the pluralities of the sandwiching members 22*a* and 22*b* are arranged lengthwise of the wire-clamping-bar body 21. The sandwiching members 22*a* and 22*b* hold the electric wire 5 therebetween.

It is by virtue of the sandwiching members 22*a* and 22*b* holding the electric wire 5 therebetween that the electric wire holding unit 11 is operable to hold the electric wire 5 having the terminal 6 that is to be inserted into the terminal accommodating chamber 4. Likewise, the electric wire holding unit 11 holds the electric wire 5 having the terminal 6 that has been inserted into the terminal accommodating chamber 4 of the connector housing 3, using the sandwiching members 22*a* and 22*b*, and thus holds the electric wire 5 to which the terminal 6 is attached. Therefore, this means that the electric wire holding unit 11 is operable to hold the connector housing 3 by means of the electric wires 5 held by the sandwiching members 22*a* and 22*b*.

Referring to FIG. 1, the connector housing holding unit 12 includes a supporting table 25, a movable supporting unit 26 that has (i) a horizontally moving unit 23 and (ii) a lifting unit 24, and a holding jig 27 operable to hold the connector housing.

The horizontally moving unit 23 has a motor (not shown) and a ball screw 28. The motor is mounted on the apparatus body 10. The ball screw 28 has a threaded shaft 29 and a nut 30. The threaded shaft 29 of the ball screw 28 is rotatably supported by the apparatus body 10 such that the threaded shaft 29 is longitudinally parallel to the horizontal direction in FIG. 1. Driven by the motor, the threaded shaft 29 rotates around a shaft center of the threaded shaft 29.

The threaded shaft 29 is longitudinally parallel to the direction from the proximal side to the distal side or vice versa in FIG. 1. The nut 30 is screwed onto the threaded shaft 29. The holding jig 27, which is supported by the lifting unit 24, is disposed on the nut 30 via the lifting unit 24. The horizontally moving unit 23 moves the nut 30 and the holding jig 27 lengthwise of the threaded shaft 29 by a rotational driving force of the motor.

The lifting unit 24 has a motor 34 and a ball screw 31. The motor 34 is mounted on the nut 30. The ball screw 31 has a threaded shaft 32 and a nut 33. The threaded shaft 32 is rotatably supported by the nut 30 such that the threaded shaft 32 is longitudinally parallel to the vertical direction in FIG. 1. Driven by the motor 34, the threaded shaft 32 rotates about a shaft center of the threaded shaft 32. The nut 33 is screwed onto the threaded shaft 32. The supporting table 25 (and therefore the holding jig 27 by means of the supporting table 25) is mounted on the nut 33. The lifting unit 24, driven by a rotational driving force of the motor 34, moves the nut 33 and the holding jig 27 lengthwise of the threaded shaft 32. Thus, the holding jig 27 is vertically movably supported by the lifting unit 24.

The holding jig 27 along with the connector housing 3 held by the holding jig 27 is movably supported by the movable supporting unit 26 by virtue of the horizontally moving unit 23 and the lifting unit 24. This is how the holding jig 27 holding the connector housing 3 is made movable in the horizontal and vertical directions.

The supporting table 25 is mounted on the nut 33 of the lifting unit 24. The supporting table 25 extends from the nut 33 of the lifting unit 24, approaching in the horizontal direction the electric wire holding unit 11.

Figure 2:
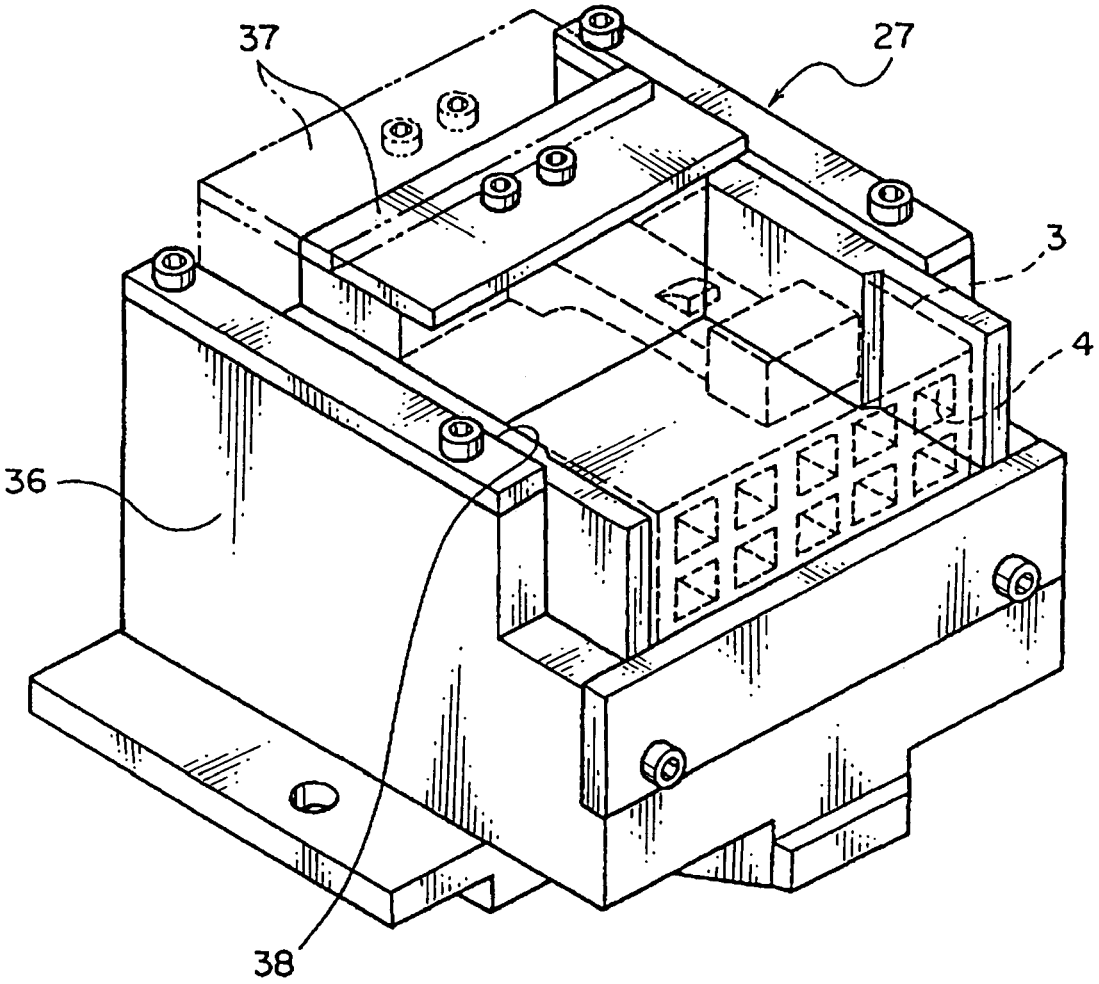
FIG. 2 is a perspective view of a holding jig of the terminal insertion apparatus of FIG. 1.

The holding jig 27 is mounted on the supporting table 25. As illustrated in FIG. 2, the holding jig 27 has an approximately square-shaped holding jig body 36, a sliding member 37, and a coil spring (not shown) as a biasing member. A notch 38 is formed on the holding jig body 36 in contact with the sliding member 37. The notch 38 extends from an upper surface of the holding jig body 36 to an edge of a side of the holding jig body 36 nearer to the electric wire holding unit 11.

The sliding member 37 is disposed in the notch 38. The sliding member 37 is supported by the holding jig body 36 so as to be slid in a direction in which the sliding member moves close to and away from the electric wire holding unit 11. As indicated by a solid line in FIG. 2, when the sliding member 37 approaches the electric wire holding unit 11, the sliding member 37 and the holding jig body 36 hold therebetween the connector housing 3, and the connector housing 3 is guided in a width direction by the notch 38 of the sliding member 37 adapted to an outer shape of the connector housing 3, and in a height direction by an upper plate of the sliding member 37 so that disengagement of the connector housing 3 from the holding jig body 36 is avoided.

When the sliding member 37 moves away from the electric wire holding unit 11, the connector housing 3 is allowed to be released from the holding jig body 36 along the notch of the sliding member 37. This state is indicated by a chain double-dashed line in FIG. 2. It should be noted that, in the specification of the present invention, a state indicated by a solid line in FIG. 2 is referred to as a disengagement-protected state. Likewise, the chain double-dashed line in FIG. 2 indicates a disengagement-allowable state.

The coil spring biases the sliding member 37 in a direction in which the sliding member 37 moves away from the electric wire holding unit 11.

Thus, the holding jig 27 can be moved within a range from the disengagement-allowable state in which the holding jig 27 is allowed to be released from the connector housing 3 to the disengagement-protected state in which the connector housing 3 is prevented from being accidentally taken out of the holding jig 27. Also, various types of the holding jig 27 with different configurations can be used depending upon the connector housings 3 with various part numbers.

In order to insert the terminal 6 into the terminal accommodating chamber 4 of the connector housing 3, the connector housing holding unit 12 ensures that the supporting table 25 along with the holding jig 27 mounted on the supporting table 25 be raised by the lifting unit 24. Also, the connector housing holding unit 12 ensures that the holding jig 27 be kept in the disengagement-protected state by virtue of an air cylinder (not shown), and that the connector housing 3 remain to be held by the holding jig 27.

When all the terminals 6 have been inserted into the terminal accommodating chambers 4 of the connector housing 3, i.e., when the last one of the terminals 6 has been inserted into the terminal accommodating chamber 4, the connector housing holding unit 12 moves the holding jig 27 into the disengagement-allowable state by virtue of the air cylinder (not shown). Further, the holding jig 27 is lowered by the lifting unit 24 while a wire chuck unit 61 holds the electric wire 5 having the last one of the terminals 6 that has been last inserted into the terminal accommodating chamber 4. Finally, the connector housing holding unit 12 allows the connector housing 3 to be released from the holding jig 27.

Referring again to FIG. 1, the guiding unit 13 has a body plate 39, a front-rear cylinder (not shown), a lift cylinder 42, a lifting plate 43, a fixed guiding plate 44, an opening-closing cylinder, and a movable guiding plate 46.

The body plate 39 is arranged on an upper end on a far side away from the table 16 of the upstanding pillar 17. The body plate 39 extends from the upstanding pillar 17 toward the electric wire holding unit 11.

The front-rear cylinder has a cylinder body and an extensible rod provided on the cylinder body. The cylinder body is disposed on the body plate 39 such that the cylinder body becomes closer to the electric wire holding unit 11 when the rod is longitudinally parallel to the horizontal direction and a length of the rod is increased. When the length of the rod is increased, the front-rear cylinder causes the guiding plates 44 and 46 to move away from the holding jig 27 and approach the electric wire holding unit 11. When the length of the rod is decreased, the front-rear cylinder causes the guiding plates 44 and 46 to approach the holding jig 27.

The lift cylinder 42 has a cylinder body 49 and an extensible rod which, though not illustrated, disposed on the cylinder body 49. The cylinder body 49 is disposed on the body plate 39 such that the rod is longitudinally parallel to the vertical direction and that the cylinder body becomes closer to the connector housing holding unit 12 when a length of the rod is increased.

When the length of the rod is increased, the lift cylinder 42 causes the lifting plate 43 along with the guiding plates 44 and 46 to move closer to the holding jig 27. When the length of the rod is decreased, the lift cylinder 42 causes the lifting plate 43, the guiding plates 44, and 46 to move away from the holding jig 27. Thus, the lifting plate 43, therefore, the guiding plates 44 and 46 are supported by the lift cylinder 42 so as to be raised and lowered. Note that the guiding plates 44 and 46 are a fixed guiding plate 44 and a movable guiding plate 46, respectively.

The lifting plate 43 is disposed on the rod of the lift cylinder 42. The fixed guiding plate 44 is mounted on the lifting plate 43. A vertical portion 51 extending in the vertical direction and a horizontal portion 52 extending in the horizontal direction from a lower end of the vertical portion 51 are formed integrally with the fixed guiding plate 44 (see FIG. 4).

The opening-closing cylinder has a cylinder body and an extensible rod extending form the cylinder body. The opening-closing cylinder is disposed on the lifting plate 43 such that the rod is longitudinally parallel to the vertical direction and that the opening-closing cylinder becomes closer to the connector housing holding unit 12 when a length of the rod is increased. When the length of the rod is increased, the opening-closing cylinder causes the movable guiding plate 46 to get close to the holding jig 27. When the length of the rod is decreased, the opening-closing cylinder causes the movable guiding plate 46 to move away from the holding jig 27.

Figure 4:
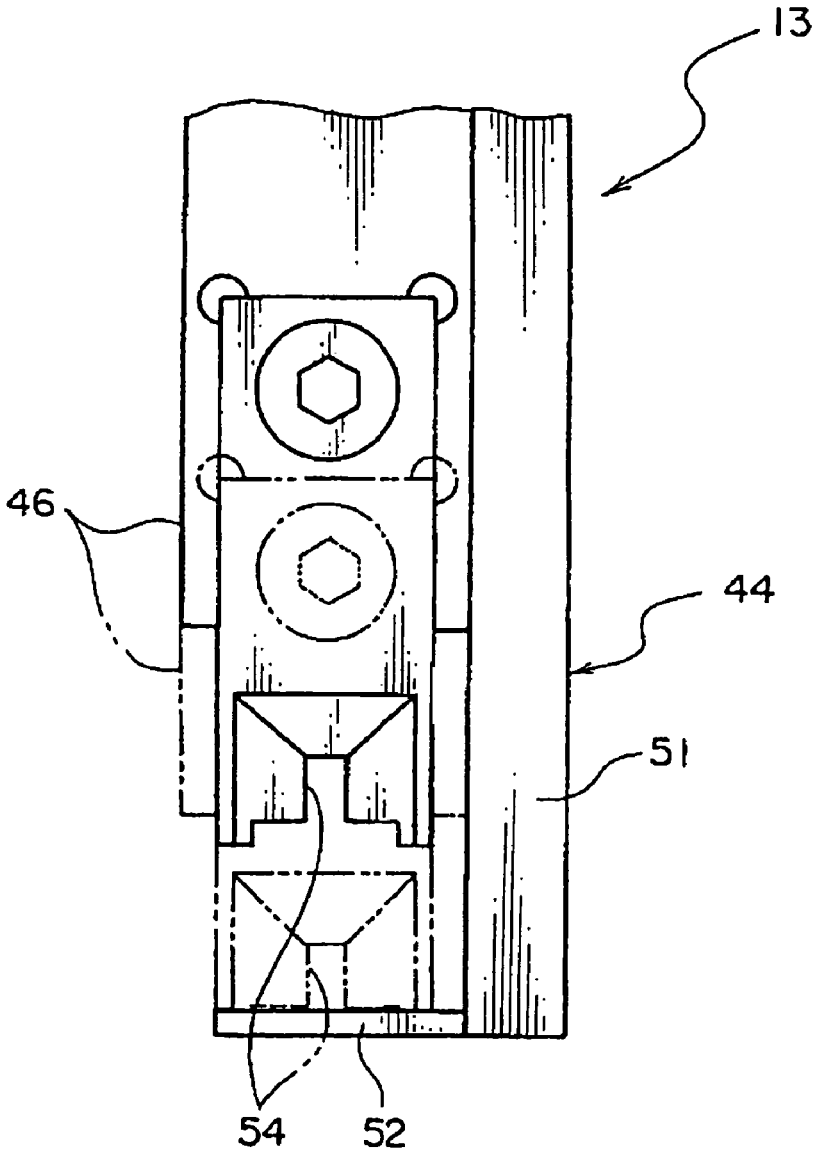
FIG. 4 is a front elevation of a guide unit of the terminal insertion apparatus of FIG. 1.

It is in this manner that the movable guiding plate 46 is supported by the opening-closing cylinder so as to be raised or lowered and, accordingly, the movable guiding plate 46 is movable within a range from a position indicated by a solid line in FIG. 4 through to a position indicated by a chain double-dashed line in FIG. 4.

The movable guiding plate 46 is provided on the rod of the opening-closing cylinder. The movable guiding plate 46 is vertically movably supported by the lifting plate 43. A longer side of the movable guiding plate 46 is arranged in the vertical direction so as to take a shape of a band plate. A guiding notch 54 is disposed at a lower end of the movable guiding plate 46. A width of an opening of the guiding notch 54 diminishes in the horizontal direction (a width direction in FIG. 1) toward the holding jig 27, and finally the width becomes equal to a width of an opening of the terminal accommodating chamber 4.

The operation of the guiding unit 13 is further described. When the length of the rod of the opening-closing cylinder is decreased, the length of the rod of the front-rear cylinder is increased, and the length of the rod of the lift cylinder 42 is increased while the holding jig 27 of the connector housing holding unit 12 is positioned lower than the guiding unit 13, then the guiding plates 44 and 46 overlap in the parallel direction with the opening of the terminal accommodating chamber 4 of the connector housing 3 held by the holding jig 27. Following this, the length of the rod of the opening-closing cylinder is increased and the horizontal portion 52 of the fixed guiding plate 44 and the lower end of the movable guiding plate 46 are brought into contact with each other.

Further, the horizontal portion 52 covers a lower portion of the guiding notch 54, and a planar shape of the guiding notch 54 becomes identical with a planar shape of the opening of the terminal accommodating chamber 4. Further, the length of the rod of the front-rear cylinder is decreased, and the guiding plates 44 and 46 are fitted to the connector housing 3 held by the holding jig 27. At this point, the guiding notch 54 communicates with the terminal accommodating chamber 4 to enable insertion of the terminal 6. Thus, the guiding unit 13 guides the terminal 6 into the terminal accommodating chamber 4 by passing the terminal 6 of the electric wire 5 through the guiding notch 54.

Still referring again to FIG. 1, the terminal insertion unit 14 has a horizontally moving unit 55, a horizontal movement plate 56, a lift cylinder (not shown), a lifting plate (not shown), an insertion cylinder 59, a front chuck unit 60, and the wire chuck unit 61.

The horizontally moving unit 55 has a motor (not shown), a ball screw 62, and a linear guide 63. The motor is mounted on the apparatus body 10. The ball screw 62 has a threaded shaft 64 and a nut 65. The threaded shaft 64 is rotatably supported by, for example, an upper end of the upstanding plate 18 of the apparatus body 10 such that the threaded shaft 64 is longitudinally parallel to the horizontal direction. The threaded shaft 64 is driven by the motor and rotates about a shaft center of the threaded shaft 64. Note that the longitudinal direction of the threaded shaft 64 is in parallel to the direction from the proximal side to the distal side in FIG. 1. The nut 65 is screwed onto the threaded shaft 64. Mounted on the nut 65 is the horizontal movement plate 56 along with the front chuck unit 60 and the wire chuck unit 61.

The linear guide 63 has a rail 66 and a slider 67. The rail 66 is disposed for example on the upstanding plate 18 and is longitudinally parallel to the threaded shaft 64. The slider 67 is slidably disposed on the rail 66 along a longitudinal direction of the rail 66. Disposed on the slider 67 is the aforementioned horizontal movement plate 56 along with the front chuck unit 60 and the wire chuck unit 61.

The horizontally moving unit 55 moves the nut 65 and the horizontal movement plate 56 along with the front chuck unit 60 and the wire chuck unit 61 lengthwise of the threaded shaft 64 by virtue of a rotational driving force of the motor.

The horizontal movement plate 56 is disposed on the nut 65 and the slider 67. The horizontal movement plate 56 extends downward from the nut 65 and the slider 67. The horizontal movement plate 56 has an electric-wire-abutting plate 57 extending downward so as to come into abutment with the electric wire 5 that has been released from the wire clamping bar 20.

The lift cylinder has a cylinder body disposed on the horizontal movement plate 56 and an extensible rod that can be extended from the cylinder body. The lift cylinder raises and lowers the lifting plate by increasing and decreasing a length of the rod.

The lifting plate is supported by the horizontal movement plate 56 so as to be raised or lowered, and is movably supported in a direction parallel to the horizontal movement plate and in a direction in which the lifting plate moves close to and away from the connector housing holding unit 12.

The insertion cylinder 59 has an insertion cylinder body 69 disposed on the horizontal movement plate 56 and an extensible rod 70 that can be extended from the cylinder body 69. A lifting plate is disposed on the rod 70. When a length of the rod 70 is increased, the insertion cylinder 59 causes the lifting plate along with the front chuck unit 60 and the wire chuck unit 61 to approach the connector housing holding unit 12. When the length of the rod 70 is decreased, the insertion cylinder 59 causes the lifting plate along with the front chuck unit 60 and the wire chuck unit 61 move away from the connector housing holding unit 12. Thus, the insertion cylinder 59 causes the lifting plate along with the front chuck unit 60 and the wire chuck unit 61 to move close to and away from the connector housing holding unit 12.

The front chuck unit 60 has a lift cylinder 71, a supporting plate 72, a chuck cylinder 73, and a pair of front chucks 74.

Figure 9:
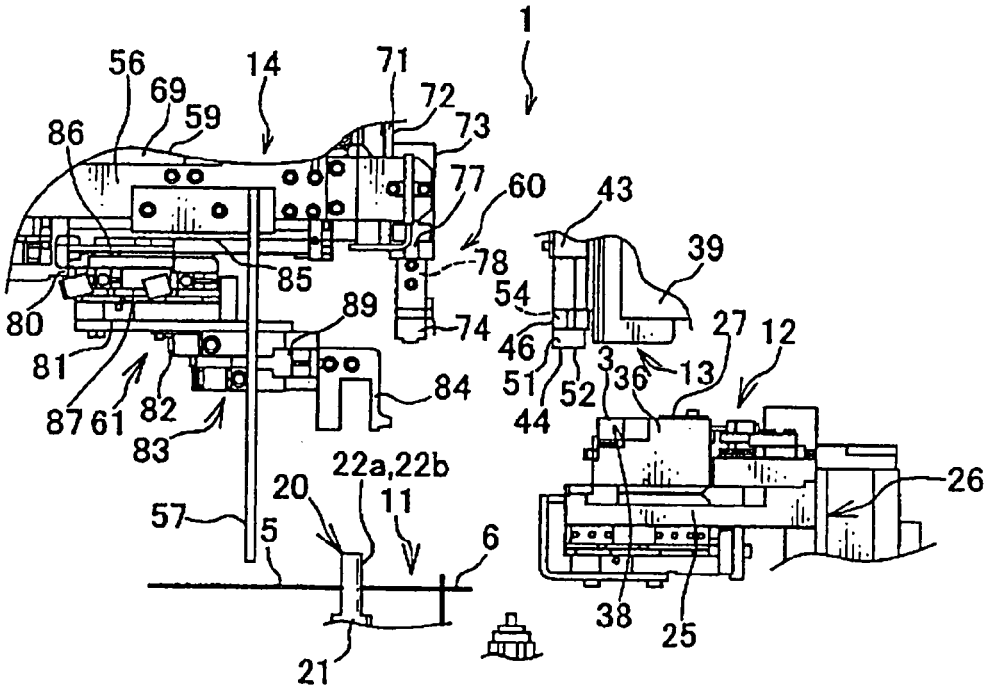
FIG. 9 is a side elevation of an initial state where the holding jig is mounted on a connector housing holding unit of the terminal insertion apparatus of FIG. 1 and the terminal insertion apparatus is ready for insertion of the terminal into the terminal accommodating chamber.

Referring to FIG. 9, the lift cylinder 71 has a cylinder body 75 and an extensible rod 76 disposed on the cylinder body 75. The cylinder body 75 is provided on an edge of the lifting plate closer to the connector housing holding unit 12. The rod 76 is lowered when a length of the rod 76 on the cylinder body 75 is increased.

Figure 5:
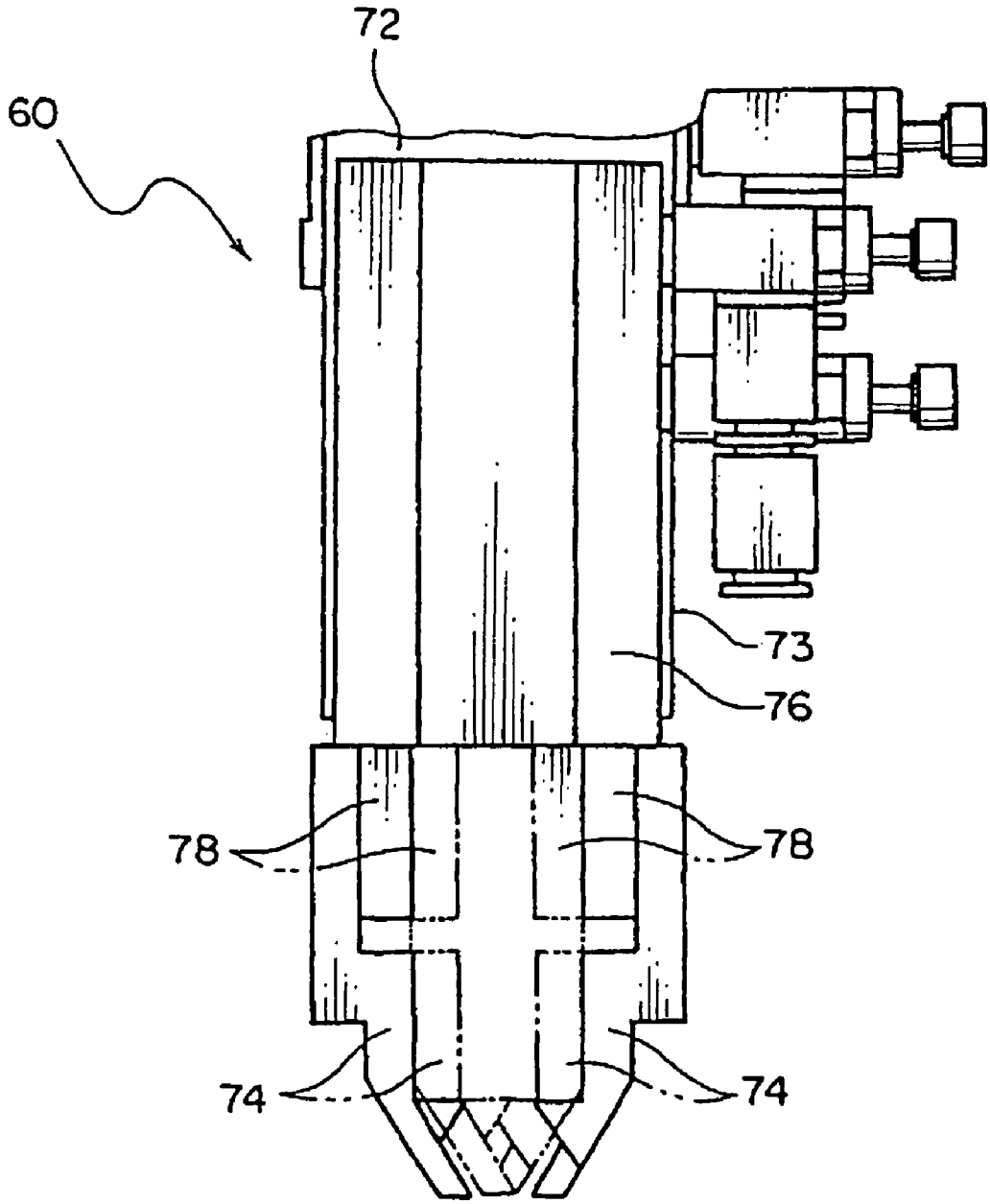
FIG. 5 is a front elevation of a front chuck unit of the terminal insertion apparatus of FIG. 1.

The supporting plate 72 is provided such that surfaces of the supporting plate 72 are both arranged in the vertical direction, and disposed on the rod 76 of the lift cylinder 71. The chuck cylinder 73, as illustrated in FIG. 5, has a cylinder body 77 disposed on the supporting plate 72 and a pair of movable rods 78 protruding from the cylinder body 7. The movable rods 78 protrude downward from the cylinder body 77 and spaced with respect to each other from the distal side to the proximal side in FIG. 1.

The pair of the movable rods 78 are displaced, moving close to and away from each other within a range from a position indicated by a solid line in FIG. 5 to a position indicated by a chain double-dashed line in FIG. 5. The front chucks 74 are provided on each of the movable rods 78, respectively. The pair of the front chucks 74 are operable to approach each other and hold the electric wire 5 therebetween.

Referring again to FIG. 1, the wire chuck unit 61 has an insertion motor 79, a ball screw 80, a check-by-pulling cylinder 81, a chuck-supporting plate 82, a chuck cylinder 83, and a pair of electric wire chucks 84.

The insertion motor 79 is disposed on a lower end of the lifting plate. The ball screw 80 has a threaded shaft 85 and a nut 86. The threaded shaft 85 is disposed such that the threaded shaft 85 is longitudinally parallel to the horizontal direction and the width direction in FIG. 1. The threaded shaft 85 is rotatably supported by the lower end of the lifting plate. The threaded shaft 85 rotates about its axis, driven by the insertion motor 79. The nut 86 is screwed onto the threaded shaft 85. Mounted on the nut 86 is the cylinder body 87 of the check-by-pulling cylinder 81. The insertion motor 79 causes the electric wire chuck 84 to move close to and away from the connector housing 3 that is held by the holding jig 27 of the connector housing holding unit 12.

The check-by-pulling cylinder 81 has a cylinder body 87 and a rod (not shown) extensible from the cylinder body 87. The cylinder body 87 is disposed on the nut 86 such that the rod is longitudinally parallel to the horizontal direction and is disposed along the width direction in FIG. 1.

The chuck-supporting plate 82 is mounted on the rod of the check-by-pulling cylinder 81. The chuck-supporting plate 82 is horizontally moved by virtue of a length of the rod of the check-by-pulling cylinder 81 on the cylinder body 87 being increased and decreased, moving close to and away from the connector housing holding unit 12.

Figure 6:
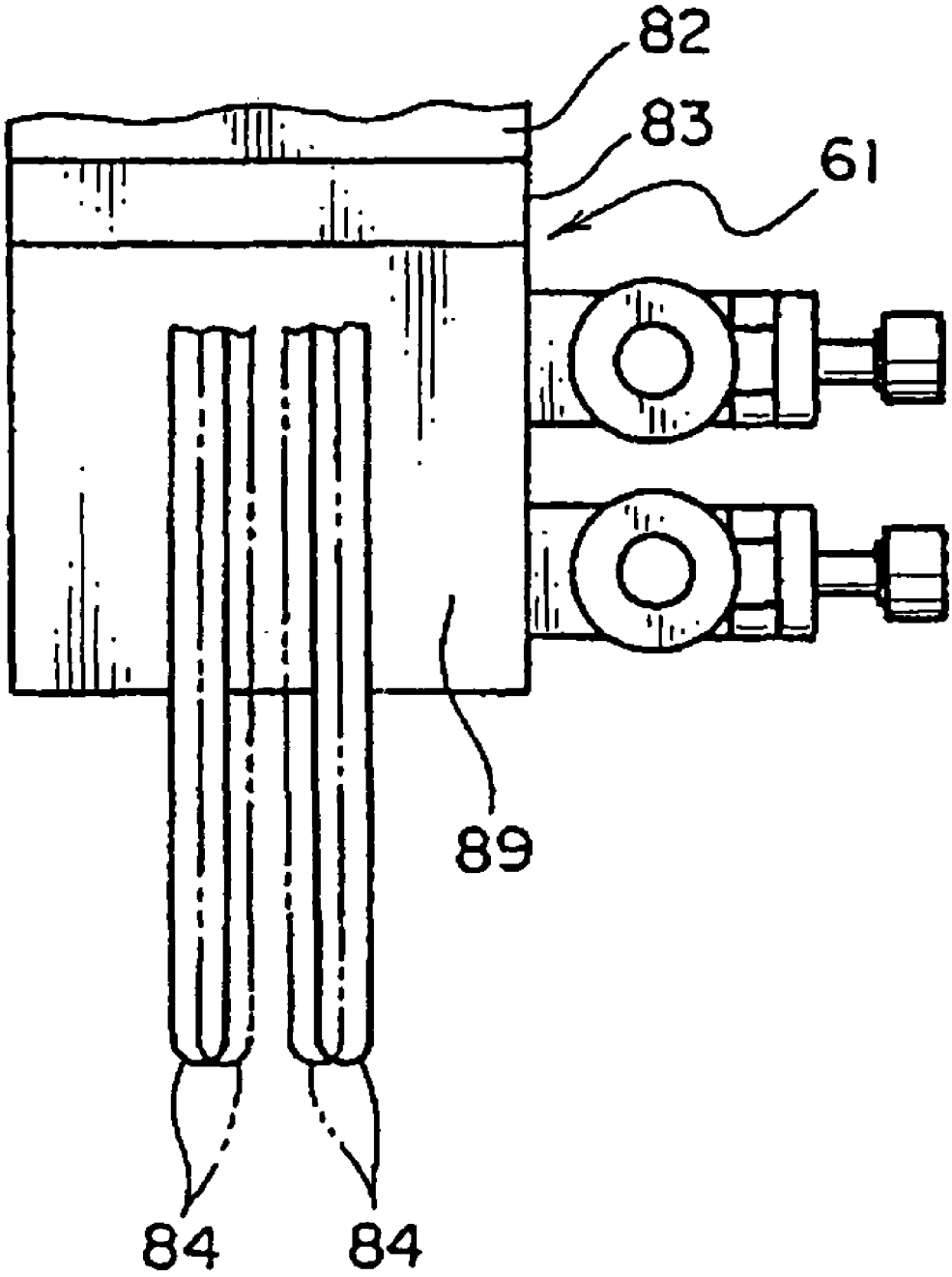
FIG. 6 is a front elevation of an electric wire chuck unit of the terminal insertion apparatus of FIG. 1.
Figure 7:
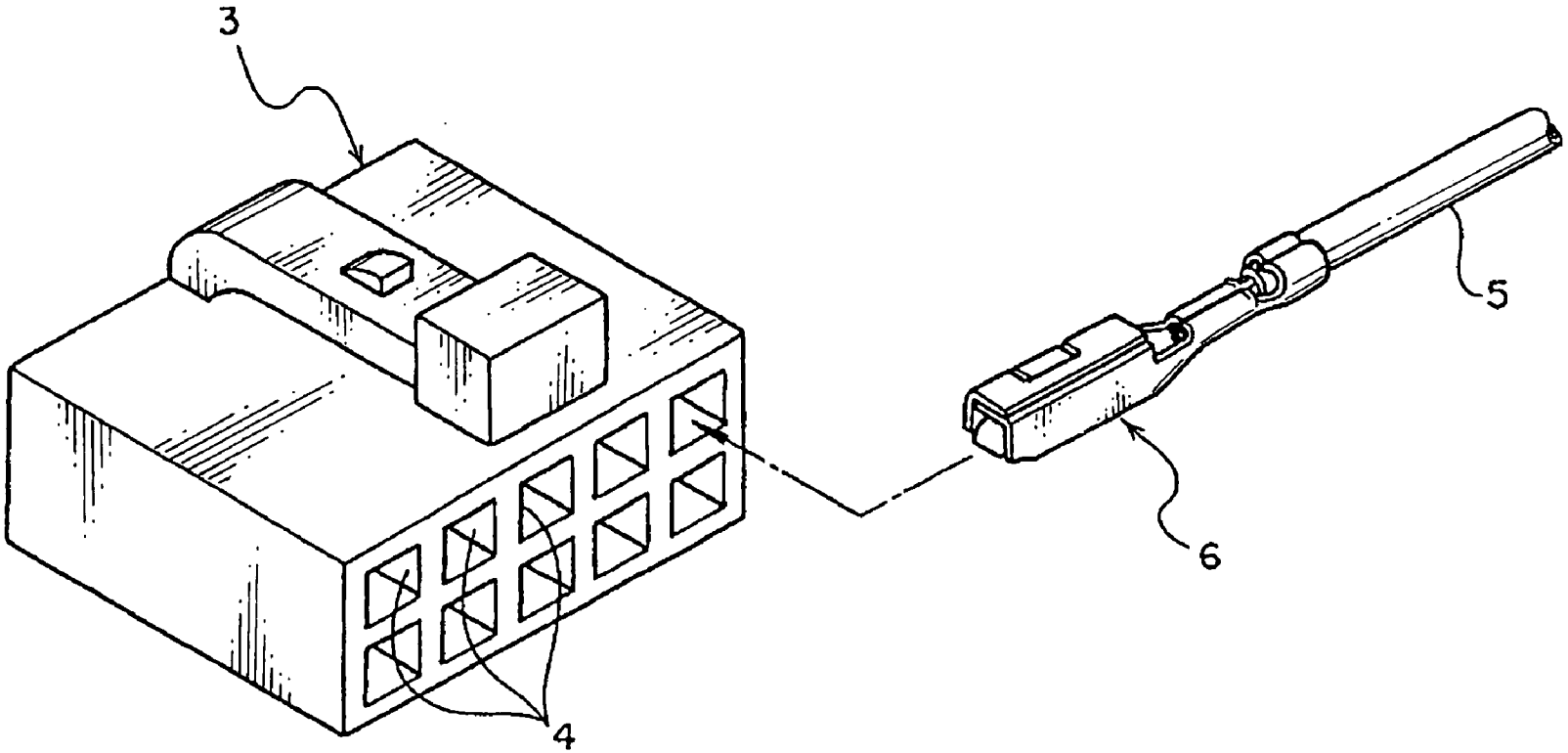
FIG. 7 is a perspective view of a connector housing held by the terminal insertion apparatus of FIG. 1.

Referring to FIG. 6 illustrating the wire chuck unit 61, the chuck cylinder 83 has a cylinder body 89 disposed on the chuck-supporting plate 82 and a pair of movable rods (not shown) protruding from the cylinder body 89. The two movable rods protrude from the cylinder body 89 toward the connector housing holding unit 12, and are spaced with respect to each other in a direction from the proximal side to the distal side or vice versa in FIG. 1. The pair of the movable rods are brought into and taken out of contact with each other. The electric wire chucks 84 are provided on each of the movable rods, respectively. This implies that the electric wire chucks 84 displace within a range from a position indicated by a solid line in FIG. 6 and a position indicated by a chain double-dashed line in FIG. 6, and that the electric wire chucks 84 move close to and away from each other. The pair of the electric wire chucks 84 approach each other and hold therebetween the electric wire 5 to which the terminal 6 is attached.

The following paragraphs describes how the terminal insertion unit 14 inserts the terminal 6 into the terminal accommodating chamber 4. To start with, the lifting plate of the terminal insertion unit 14 is moved downward by the lift cylinder 71. Next, the length of the rod 76 of the lift cylinder 71 is increased. Further, the terminal insertion unit 14 causes the movable rods 78 of the chuck cylinder 73 of the front chuck unit 60 to move close to and away from each other until the pair of the front chucks 74 sandwich therebetween the electric wire 5 held by the wire clamping bar 20, holding the electric wire 5 by its region three millimeters away from the terminal 6. Also, the terminal insertion unit 14 causes the movable rods of the chuck cylinder 83 of the wire chuck unit 61 to move close to and away from each other, and sandwiches the electric wire 5 held by the wire clamping bar 20 between the pair of the electric wire chucks 84.

Further, the terminal insertion unit 14 raises the lifting plate using the lift cylinder, and releases the terminal 6 from the wire clamping bar 20 of the electric wire holding unit 11. Thus, the terminal insertion unit 14 takes the electric wire 5 held by the electric wire holding unit 11 off the electric wire holding unit 11.

In addition, the terminal insertion unit 14 increases the length of the rod 70 of the insertion cylinder 59, and causes the lifting plate to approach the holding jig 27. The terminal insertion unit 14 inserts the terminal 6 into the guiding notch 54 of the guiding unit 13. At this point, terminal insertion unit 14 causes the pair of the front chucks 74 of the front chuck unit to move away from each other, and raises the front chuck 74 by the lift cylinder 71 of the front chuck unit 60, i.e., releases the electric wire 5 from the front chuck 74. The terminal insertion unit 14 causes the wire chuck unit 61 driven by the insertion motor 79 to come close to the holding jig 27, and inserts the terminal 6 into the terminal accommodating chamber 4 of the connector housing 3 that is held by the holding jig 27.

At this point, the connector housing 3 and the terminal 6 are secured to each other by means of the aforementioned locking arm. Then the terminal insertion unit 14 pulls the wire chuck unit 61 backward by the ball screw 80. If the terminal 6 is not taken out of the connector housing 3, the length of the rod of the check-by-pulling cylinder 81 is increased. Since the check-by-pulling cylinder 81 is capable of freely changing an air pressure by a regulator, a level of a pulling force can be adjusted according to the sizes of the terminal 6 and the connector housing 3. Further, the terminal insertion unit 14 causes the electric wire chucks 84 to move away from each other, and moves the wire chuck unit 61 away from the electric wire 5. Further, the terminal insertion unit 14 takes the electric wire 5 to be inserted for a next round of insertion off the wire clamping bar 20, and inserts the terminal 6 of the electric wire 5 into the terminal accommodating chamber 4.

When the last one of the terminals 6 has been inserted into the terminal accommodating chamber 4, the terminal insertion unit 14 remains in a state where the terminal insertion unit 14 keeps on holding the electric wire 5 whose terminal was last inserted by the wire chuck unit 61. At this point, the lifting unit 24 of the connector housing holding unit 12 moves the holding jig 27 downward, and the connector housing 3 is released from the holding jig 27.

Further, the terminal insertion unit 14, while keeping on holding the electric wire 5 whose terminal 6 was last inserted by the wire chuck unit 61, presses the electric wire 5 in between the sandwiching members 22*a* and 22*b* of the wire clamping bar 20 by virtue of operation of the insertion cylinder 59, the insertion motor 79, the lift cylinder, and the horizontally moving unit 55. Thus, the terminal insertion unit 14 carries the electric wire whose terminal 6 was last inserted into its terminal accommodating chamber 4 so as to hand over the electric wire 5 to the electric wire holding unit 11, and the electric wire holding unit 11 holds the electric wire 5 again.

The control unit 15 is a known computer having a CPU, RAM, and ROM. The control unit 15 is connected to and controls operation of the movable supporting unit 26 of the connector housing holding unit 12, the guiding unit 13, and the terminal insertion unit 14 in order to control the terminal insertion apparatus 1.

Figures 8A, 8B:
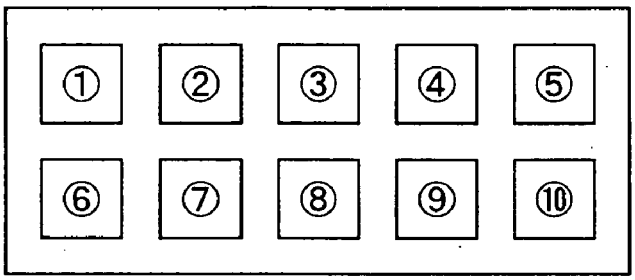
FIG. 8A shows terminal accommodating chambers of the connector housing of FIG. 7 with serial numbers.
FIG. 8B is a table showing values of amount of movement that are stored in a control unit of the terminal insertion apparatus of FIG. 1. The table indicates the amounts of movement in a horizontal direction and in a vertical direction for each terminal accommodating chamber of FIG. 8A.

The control unit 15 stores information on (a) order of insertion of the terminals 6 into the terminal accommodating chambers 4 on a per-part-number basis for the connector housings 3 to be assembled to serve as a connector 2, (b) a position of each terminal 6 to be inserted into the terminal accommodating chamber 4 while being held by the wire clamping bar 20, (c) a position of each terminal accommodating chamber 4, and (d) an amount of movement of the terminal 6 for fine adjustment after the end of the terminal 6 is inserted into the terminal accommodating chamber 4 (illustrated in FIG. 8A). The amounts of movement 1A to 10A and 1B to 10B, as indicated in FIG. 8B, are determined for each of the connector housings with various part numbers so that the terminals 6 do not get caught by the protrusions formed on the inner surface of the terminal accommodating chambers 4 during insertion. The amounts of movement 1A to 10A and 1B to 10B are degrees of adjustment by which the movable supporting unit 26 moves the connector housing 3 (via the holding jig 27) in the horizontal direction and the vertical direction. Needless to say, the information on the amounts of movement in the horizontal and vertical directions are stored in the control unit 15. These amounts of movement 1A to 10A and 1B to 10B are values that are predetermined for each terminal accommodating chamber 4 of the connector housing 3 with each part number so that the terminal 6 is not caught on the inner surface of the terminal accommodating chamber 4 during the insertion.

Further, when inserting the terminal 6 into the terminal accommodating chamber 4 of the connector housing 3 with the part number that is input by an input device 90 (to be later described), the control unit 15 causes the movable supporting unit 26 to move the holding jig 27 by the predetermined amounts of movement 1A to 10A and 1B to 10B in the horizontal and vertical directions as indicated in FIG. 8B after insertion of the end of the terminal 6 into the terminal accommodating chamber 4. Following this, the control unit 15 causes terminal insertion unit 14 to further insert the terminal 6 toward a far end of the terminal accommodating chamber 4. Thus, after the terminal insertion unit 14 has inserted the end of the terminal 6 into the terminal accommodating chamber 4, the movable supporting unit 26 controlled by the control unit 15 moves the holding jig 27 by the predetermined amounts of movement 1A to 10A and 1B to 10B which are determined so that the terminal 6 is not caught by the terminal accommodating chamber 4, and the terminal insertion unit 14 controlled by the control unit 15 inserts the terminal 6 fully into the terminal accommodating chamber 4.

The control unit 15 also stores information on positions of the sandwiching members 22*a* and 22*b* between which the electric wire 5 whose terminal 6 was last inserted is to be pressed in. Thus, the control unit 15 stores information necessary for the terminal 6 to be inserted into the terminal accommodating chamber 4 for at least one connector housing 3 having its part number assigned. Further, the input device 90 is connected to the control unit 15. The input device 90 includes a peripheral information input device such as a keyboard and other peripheral operating devices such as a switch. The input device 90 is used to input into the control unit 15 information on the part numbers of the connector housings 3 into which the terminal 6 held by the holding jig 27 is to be inserted.

Now that the structure of the terminal insertion apparatus 1 of the present invention has been described in detail including the control unit 15 and the input device 90, the following is again dedicated to how the terminal 6 is inserted into each terminal accommodating chamber 4 of the connector housing 3 using the terminal insertion apparatus 1. Before starting an insertion operation, information indicative of the part number of the connector 2 to be assembled has to be entered into the control unit 15 using the input device 90. According to the part number that has been entered, the corresponding holding jig 27 is attached to the supporting table 25 of the connector housing holding unit 12, and the wire clamping bar 20 corresponding to the above part number is attached to the wire-holding-unit body 19 of the electric wire holding unit 11.

Next, an instruction to start the insertion operation is entered into the control unit 15 using the input device 90. Then, as illustrated in FIG. 9, the lifting unit 24 of the connector housing holding unit 12 raises the holding jig 27, and the air cylinder maintains the holding jig 27 in the disengagement-protected state. Meanwhile, the control unit 15 causes the length of the rod of the front-rear cylinder of the guiding unit 13 to be increased while causing the lengths of the rods of the lift cylinder 42 and the opening-closing cylinder to be decreased.

Other preparations that have to be made are as follows: Reduce the lengths of the lift cylinder of the terminal insertion unit 14 and the rod 70 of the insertion cylinder 59. Reduce the length of the rod 76 of the lift cylinder 71 of the front chuck unit 60 of the terminal insertion unit 14. Move the movable rods 78 of the chuck cylinder 73 away from each other. Move the movable rods 78 of the chuck cylinder 83 of the terminal insertion unit 14 away from each other.

First, the control unit 15 controls the horizontally moving unit 23 of the connector housing holding unit 12, and the horizontally moving unit 23 controlled by the control unit 15 positions the terminal accommodating chamber 4, into which the first terminal 6 is inserted, at a position lower than the guiding plates 44 and 46 of the guiding unit 13. Further, the control unit 15 controls the horizontally moving unit 55 of the terminal insertion unit 14 so as to position the front chuck unit 60 of the terminal insertion unit 14 at an upper region relative to the terminal 6 that is to be firstly inserted into the terminal accommodating chamber 4, and to position the wire chuck unit 61 of the terminal insertion unit 14 at an upper area relative to the electric wire 5.

Next, the control unit 15 causes the length of the rod of the lift cylinder 42 of the guiding unit 13 to be increased, and the fixed guiding plate 44 to overlap with an opening of the terminal accommodating chamber 4 of the connector housing 3 held by the holding jig 27. Also, the control unit 15 causes the length of the rod 76 of the lift cylinder 71 of the front chuck unit 60 of the terminal insertion unit 14 to be increased, controls the lift cylinder of the terminal insertion unit 14, and the control unit 15 further causes the front chuck unit 60 and the wire chuck unit 61 to approach the terminal 6 and the electric wire 5 held by the electric wire holding unit 11.

At this point, terminal 6 resides between the pair of the front chucks 74, and the electric wire 5 resides between the pair of the electric wire chucks 84. Also, the control unit 15 controls the front chuck unit 60 and the chuck cylinders 73 and 83 of the wire chuck unit 61, grasps the electric wire 5 in between the front chucks 74, getting hold of the electric wire 5 in between the electric wire chucks 84.

Figure 10:
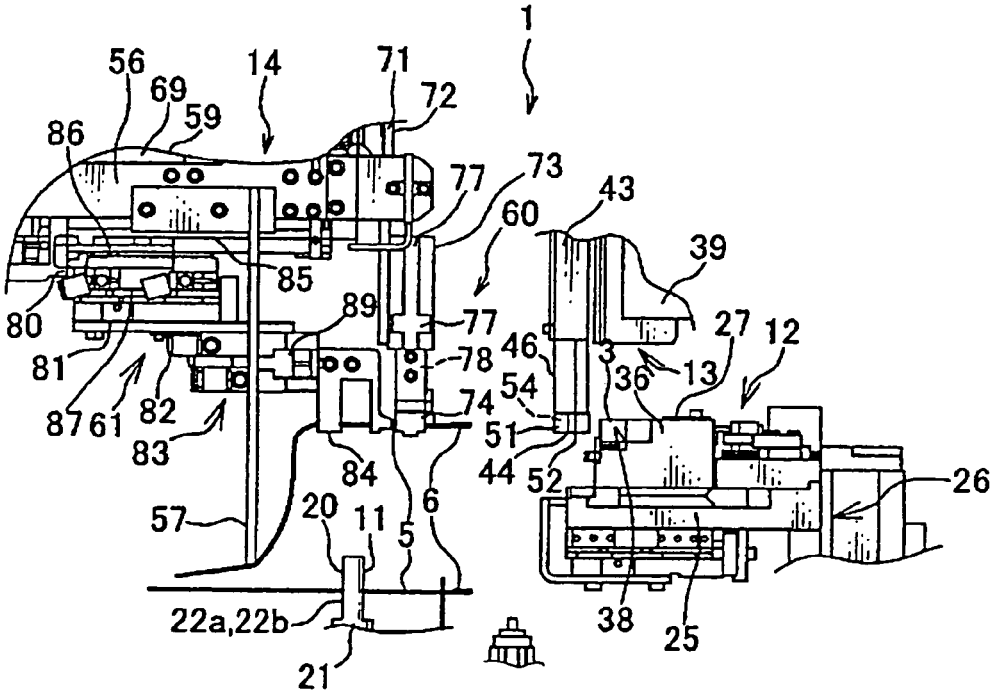
FIG. 10 is a side elevation of the terminal insertion apparatus of FIG. 1 where, after exit from the initial state illustrated in FIG. 9, an electric wire with the terminal is released from the wire clamping bar.

Referring to FIG. 10, the lift cylinder of the terminal insertion unit 14 controlled by the control unit 15 moves the front chuck unit 60 and the wire chuck unit 61 upward, and removes the electric wire held by the chuck units from the wire clamping bar 20 of the electric wire holding unit 11. At this point, the terminal accommodating chamber 4 of the connector housing 3 held by the holding jig 27 faces the electric wire 5 having the terminal 6 held by the front chuck unit 60. Further, the control unit 15, as illustrated in FIG. 10, controls the opening-closing cylinder, and brings the lower end of the movable guiding plate 46 into contact with the horizontal portion 52 of the fixed guiding plate 44.

Figure 11:
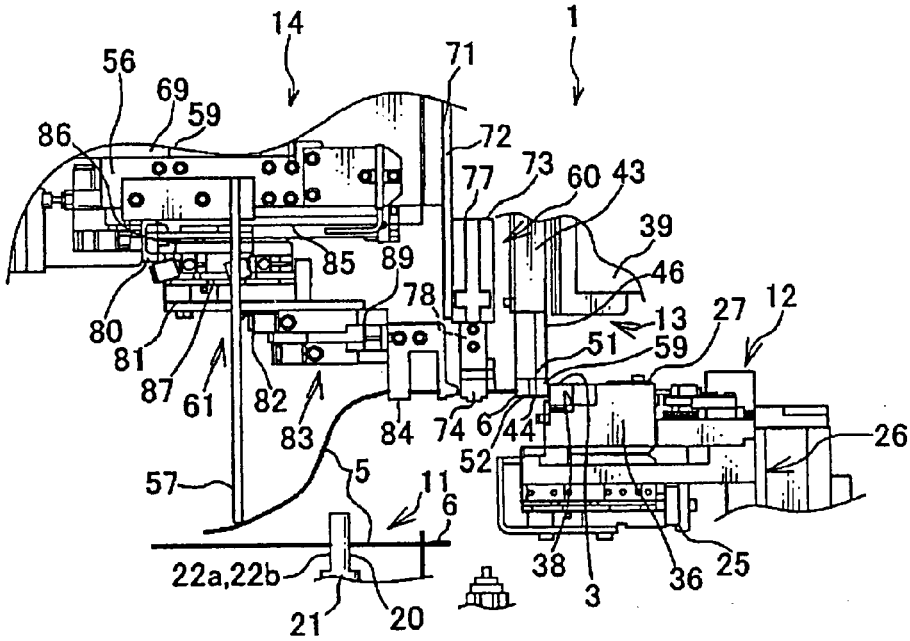
FIG. 11 is a side elevation of the terminal insertion apparatus of FIG. 1 where, following the state of FIG. 10, the terminal is inserted into the guiding plate, guided by a guiding notch of the guiding plate.
Figure 12:
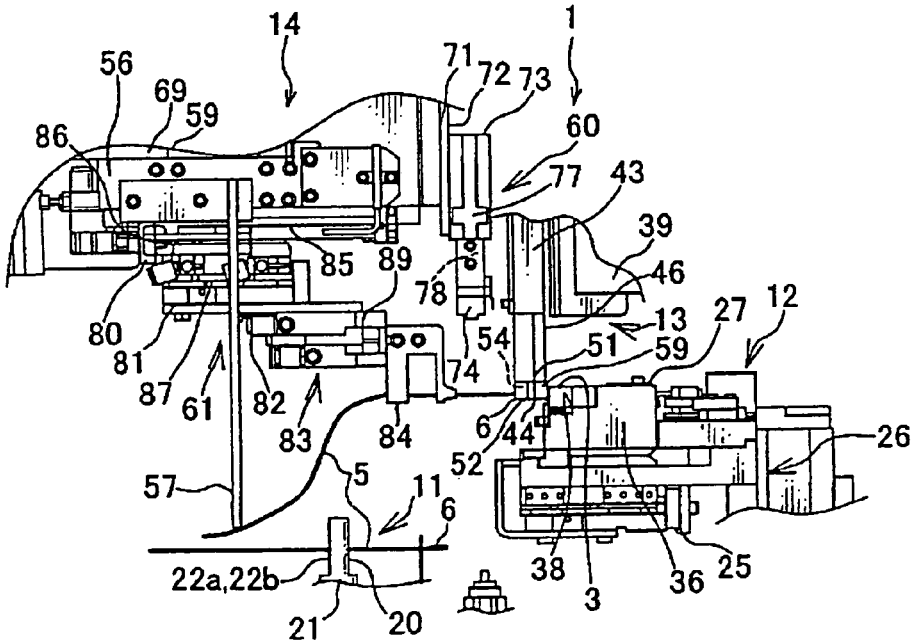
FIG. 12 is a side elevation of the terminal insertion apparatus of FIG. 1 where, following the state of FIG. 11, the front chuck unit is raised.
Figure 13:
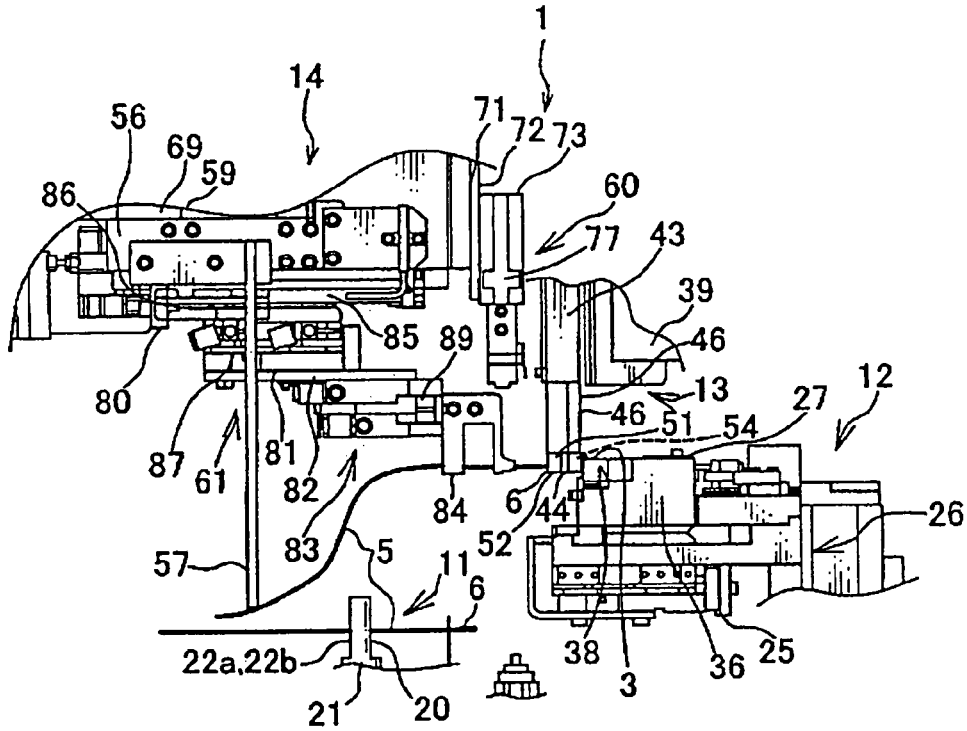
FIG. 13 is a side elevation of the terminal insertion apparatus of FIG. 1 where, following the state of FIG. 12, an end of the terminal is inserted into the terminal accommodating chamber of the connector housing.

Still referring to FIG. 10, the control unit 15 controls the terminal insertion apparatus 1 so that the length of the rod of the front-rear cylinder of the guiding unit 13 is decreased, and the fixed guiding plate 44 is brought into contact with the connector housing 3 held by the holding jig 27. Further, the control unit 15 controls the terminal insertion apparatus 1, as illustrated in FIG. 11, causes the length of the rod 70 of the insertion cylinder 59 of the terminal insertion unit 14 to be increased, and inserts the terminal 6 into the guiding notch 54 of the movable guiding plate 46 of the guiding unit 13. After that, the control unit 15, as illustrated in FIG. 12, controls the chuck cylinder 73 of the front chuck unit 60 of the terminal insertion unit 14, causing the front chuck 74 to be moved away from the electric wire 5, and the control unit 15 further controls the lift cylinder 71 of the front chuck unit 60, causing the front chuck 74 to be moved upward (detached from the terminal 6). Still further, the control unit 15 controls the insertion motor 79 of the terminal insertion unit 14 and inserts the end of the terminal 6 into the terminal accommodating chamber 4 of the connector housing 3 held by the holding jig 27 (see FIG. 13).

Figure 14:
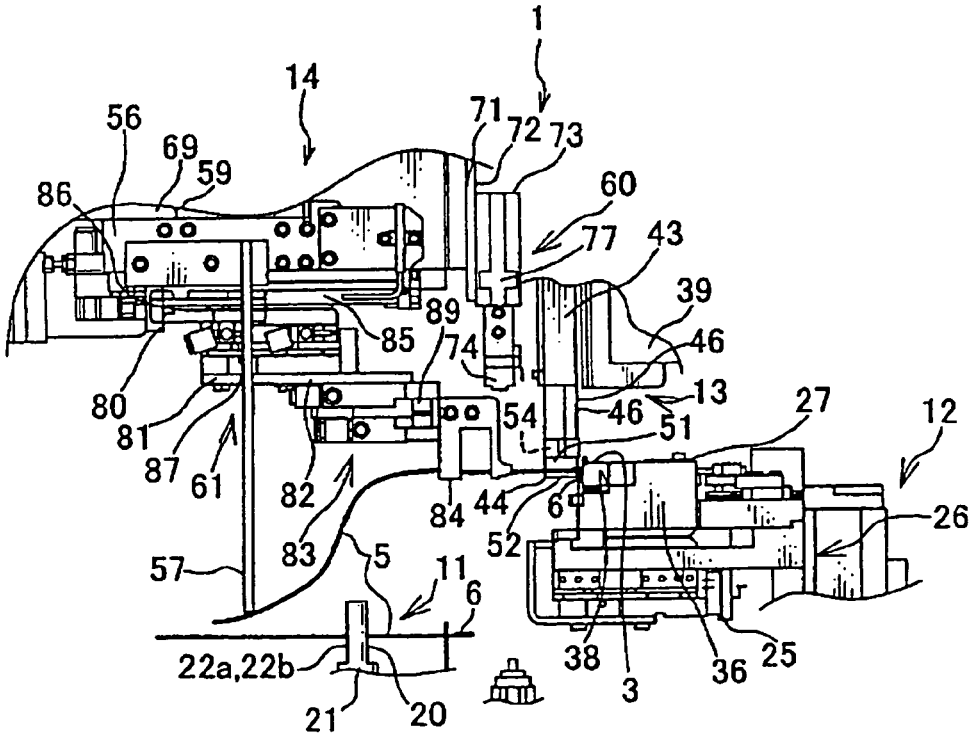
FIG. 14 is a side elevation of the terminal insertion apparatus of FIG. 1 where, following the state of FIG. 13, the connector housing is released from a guiding plate of the guiding unit.

After that, the control unit 15 reads the information indicative of the amounts of movement 1A to 10A and 1B to 10B in horizontal and vertical directions for the terminal accommodating chambers 4 into which the end of the terminals 6 are to be inserted (the terminal accommodating chambers 4 pertain to the part number-assigned connector housing 3 held by the holding jig 27). The control unit 15 causes the movable supporting unit 26 to move the connector housing 3 via the holding jig 27 by the amounts of movement 1A to 10A and 1B to 10B. The control unit 15, as illustrated in FIG. 14, controls the opening-closing cylinder of the guiding unit 13 and causes the movable guiding plate 46 to be moved upward, and the length of the rod of the front-rear cylinder to be increased, causing the fixed guiding plate 44 to be detached from the connector housing 3. Further, the control unit 15 controls the horizontally moving unit 23 of the connector housing holding unit 12 and the horizontally moving unit 55 of the terminal insertion unit 14, while electric wire chuck 84 keeps on holding the electric wire 5, causing the chuck units 60 and 61 of the terminal insertion unit 14 and the holding jig 27 of the connector housing holding unit 12 to be moved together, for example, toward a proximal side of the FIG. 14.

Figure 15:
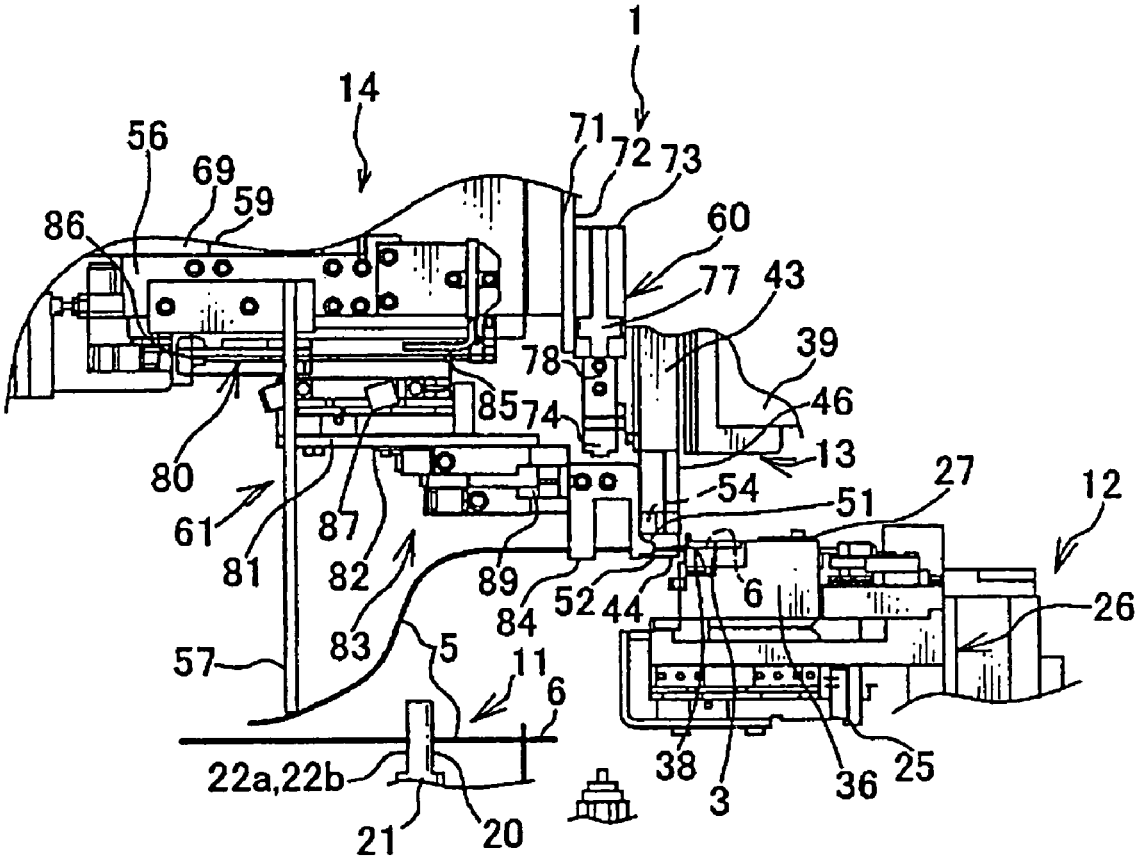
FIG. 15 is a side elevation of the terminal insertion apparatus of FIG. 1 where, following the state of FIG. 14, the terminal is fully inserted into the terminal accommodating chamber.
Figure 16:
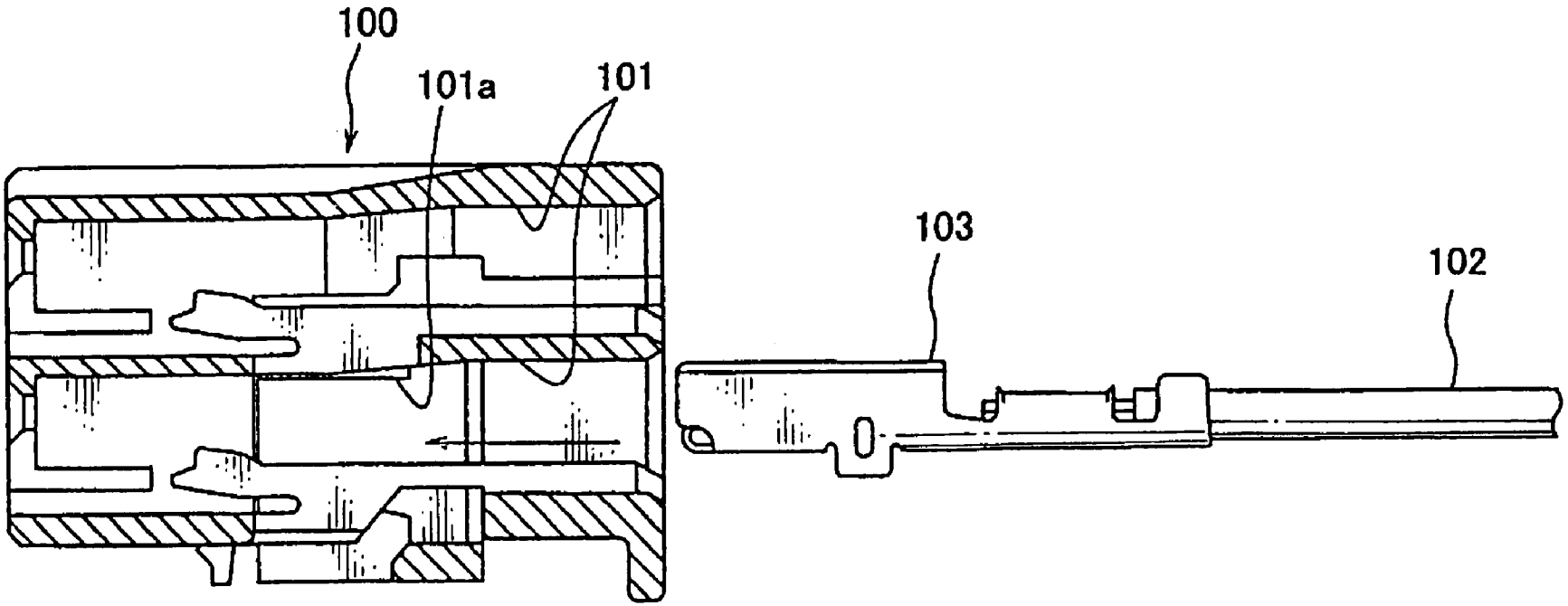
FIG. 16 PRIOR ART
FIG. 16 is a cross-sectional view of a conventional connector housing and a conventional terminal.
Figure 17:
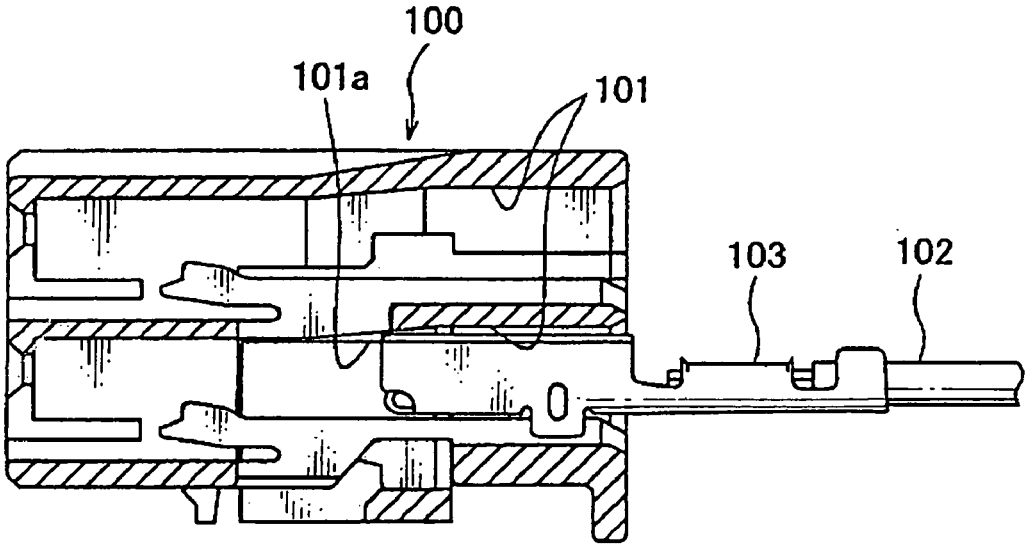
FIG. 17 PRIOR ART
FIG. 17 is a cross-sectional view of the conventional terminal of FIG. 16 being caught by an inner surface of a terminal accommodating chamber of the conventional connector housing of FIG. 16.
Figure 18:
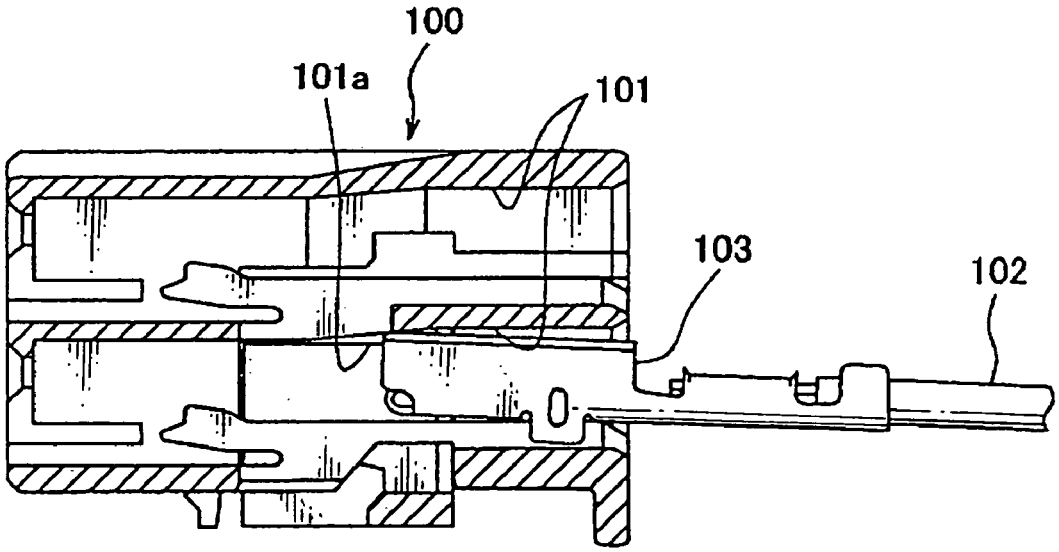
FIG. 18 PRIOR ART
FIG. 18 is a cross-sectional view of the conventional connector housing of FIG. 17 with the conventional terminal of FIG. 17 that is slanted to a bottom side of the connector housing.

At this point, the electric wire 5 is taken out of the area between the horizontal portion 52 of the fixed guiding plate 44 and the movable guiding plate 46. The control unit 15 controls the insertion motor 79 of the terminal insertion unit 14, and, as illustrated in FIG. 15, inserts the terminal 6 toward the far end of the terminal accommodating chamber 4 of the connector housing 3 held by the holding jig 27. Further, the wire chuck unit 61 controlled by the control unit 15 moves the electric wire chuck 84 away from the electric wire 5. Further, the control unit 15 repeats the process illustrated in FIG. 9 through to FIG. 15, and inserts the terminals 6 one by one into the terminal accommodating chambers 4.

After the last one of the terminals 6 is inserted, the control unit 15 controls the air cylinder of the connector housing holding unit 12, and the holding jig 27 is positioned at the disengagement-allowable state. Further, while the wire chuck unit 61 keeps on holding the electric wire 5 whose terminal 6 was last inserted into the terminal accommodating chamber 4, the lifting unit 24 of the connector housing holding unit 12 controlled by the control unit 15 lowers the holding jig 27.

At this point, since the electric wire 5 is held by the electric wire chuck 84, the connector housing 3 is released from the holding jig 27. Also, the horizontally moving unit 55 of the terminal insertion unit 14 controlled by the control unit 15 positions the electric wire chuck 84 to a higher position when viewed from the sandwiching members 22*a* and 22*b* that sandwich the electric wire 5 attached to the connector housing 3. Further, the lift cylinder of the terminal insertion unit 14 controlled by the control unit 15 lowers the electric wire chuck 84, and press the electric wire 5, which is now connected to the connector housing 3 and held by the electric wire chuck 84, in between the sandwiching members 22*a* and 22*b*. Thus, the electric wire 5 attached to the connector housing 3 is held by the electric wire holding unit 11.

According to the above embodiment, since it is not until the end of the terminal 6 has been inserted into the terminal accommodating chamber 4 that the connector housing 3 is moved for fine adjustment controlled by the control unit 15, the position of the connector housing 3 relative to the terminal 6 can be adjusted so that the terminal 6 is not caught by the inner surface of the terminal accommodating chamber 4. Therefore, the terminals 6 can be securely and completely inserted into the terminal accommodating chambers, 4 and the electric wires 5 are protected against deformation caused by buckling or bending.

In addition, the control unit 15 stores the information on the amounts of movement of 1A through to 10A in the horizontal direction and 1B through to 10B in the vertical direction in insertion of the terminals 6 into the terminal accommodating chambers 4 for each part-number-assigned connector housing 3, and moves the connector housings 3 by the stored amounts of movement 1A to 10A and 1B to 10B, which allows the terminal 6 to be securely inserted into the terminal accommodating chamber 4 by virtue of individual adjustment on a per-part-number basis for each connector housing 3.

Further, since the input device 90 is used to enter the part numbers of the connector housings 3, the position of the connector housing 3 relative to the terminal 6 can be adjusted so that the terminal 6 is not caught by the inner surface of the terminal accommodating chamber 4. In other words, the terminal 6 can be securely and completely inserted into the terminal accommodating chamber 4 without getting caught on the inner surface of the terminal accommodating chamber 4.

In the embodiment described above, the terminals 6 are inserted into all of the terminal accommodating chambers 4 of the connector housing 3. However, this does not mean that all of the terminal accommodating chambers 4 of the connector housing 3 have to be inserted into by the terminals 6. In short, in this invention, the terminal insertion unit 14 have only to insert desired number of the terminals 6 into the corresponding terminal accommodating chambers 4 of the connector housing 3 after having inserted the ends of the desired terminals 6 into the terminal accommodating chamber 4 into which the terminal 6 is intended to be inserted.

Having now fully described the invention, it is clear that the embodiments described above are illustrated as examples of the possible embodiments of the present invention, and that numerous modifications and variations can be effectuated within the spirit and scope of the present invention.

What is claimed is:

1. A method for inserting a terminal of an electric wire into a terminal accommodating chamber of a connector housing, comprising the steps in the sequence set forth:

(a) movably holding said connector housing;

(b) holding said terminal and said electric wire;

(c) inserting an end of said terminal longitudinally into said terminal accommodating chamber;

(d) in a state where said terminal end has been inserted into said terminal accommodating chamber, moving said connector housing horizontally and vertically relative to said terminal end by an amount of movement predetermined such that said terminal is not caught by a protrusion formed on an inner surface of said terminal accommodating chamber; and (e) inserting said terminal longitudinally and completely into said terminal accommodating chamber, wherein information indicative of said amount of movement for said connector in insertion of said terminal into said terminal accommodating chamber is stored in a control unit, and said connector housing is moved by said amount of movement.

2. The method of claim 1, wherein a connector housing holding unit holds the connector housing;

a movable supporting unit supports the connector housing holding unit movably;

a terminal insertion unit holds the terminal and the electric wire and inserts the terminal into the terminal accommodating chamber; and the control unit controls the terminal insertion unit to insert an end of the terminal into the terminal accommodating chamber, thereafter controls the movable supporting unit to move the connector housing holding unit by the amount of movement, and thereafter controls the terminal insertion unit so as to insert the terminal completely into said terminal accommodating chamber.

3. A method for inserting a terminal of an electric wire into a terminal accommodating chamber of a connector housing, comprising the steps of in the sequence set forth:

(a) movably holding said connector housing;

(b) holding said terminal and said electric wire;

(c) inserting an end of said terminal into said terminal accommodating chamber;

(d) in a state where said terminal end has been inserted into said terminal accommodating chamber, moving said connector housing by an amount of movement predetermined such that said terminal is not caught by a protrusion formed on an inner surface of said terminal accommodating chamber; and (e) inserting said terminal completely into said terminal accommodating chamber;

wherein information indicative of said amount of movement for said connector in insertion of said terminal into said terminal accommodating chamber is stored in a control unit, and said connector housing is moved by said amount of movement; and wherein information indicative of a part number of said connector housing is entered by an input device into said control unit, and said connector housing having the part number entered by said input device is moved by said amount of movement.

4. A method for inserting a terminal of an electric wire into a terminal accommodating chamber of a connector housing, comprising the steps in the sequence set forth:

(a) movably holding said connector housing;

(b) holding said terminal and said electric wire;

(c) inserting an end of said terminal longitudinally into said terminal accommodating chamber;

(d) in a state where said terminal end has been inserted into said terminal accommodating chamber, moving said connector housing horizontally and vertically relative to said terminal end by an amount of movement predetermined such that said terminal is not caught by a protrusion formed on an inner surface of said terminal accommodating chamber; and (e) inserting said terminal longitudinally and completely into said terminal accommodating chamber, wherein information indicative of a part number of said connector housing is entered by an input device into a control unit, and said connector housing having the part number entered by said input device is moved by said amount of movement.

* * * * *